US005249106A

United States Patent [19]

Barnes et al.

[11] Patent Number: 5,249,106

[45] Date of Patent: Sep. 28, 1993

[54] ILLUMINATED PROTECTIVE CLOTHING

[76] Inventors: Frances P. Barnes; Frederick P. Barnes, both of Rte. 9, Box 517, Mooresville, N.C. 28115

[21] Appl. No.: 958,919

[22] Filed: Oct. 9, 1992

[51] Int. Cl.[5] ..... F21L 15/08

[52] U.S. Cl. ..... 362/108; 362/32; 362/103

[58] Field of Search ..... 362/32, 103, 104, 108, 362/253, 297, 298, 806

[56] References Cited

U.S. PATENT DOCUMENTS

| | | | |
|---|---|---|---|
| 2,428,975 | 10/1947 | Lamb | 362/32 |
| 2,962,580 | 11/1960 | Jones | 362/108 |
| 3,570,158 | 3/1971 | Hackett | 40/586 |
| 4,164,008 | 8/1979 | Miller et al. | 362/103 |
| 4,234,907 | 11/1980 | Daniel | 362/108 |
| 4,283,797 | 8/1981 | Seider | 2/151 |
| 4,354,282 | 10/1982 | Langdon | 2/115 |
| 4,559,583 | 12/1985 | Ku | 362/32 |
| 4,601,120 | 7/1986 | Levin | 40/317 |
| 4,709,307 | 11/1987 | Branom | 362/103 |
| 4,727,603 | 3/1988 | Howard | 362/103 |
| 4,839,777 | 6/1989 | Janko et al. | 362/108 |
| 5,070,436 | 12/1991 | Alexander et al. | 362/108 |
| 5,128,843 | 7/1992 | Curitz | 362/103 |

*Primary Examiner*—Albert J. Makay
*Assistant Examiner*—Y. Quach
*Attorney, Agent, or Firm*—Judith E. Garmon

[57] ABSTRACT

In protective illuminated vests and jackets a light enhancement means improves visibility and protects the enclosed light emitting bulb or diode. The light enhancement means is comprised of a transparent casing for housing a preferably screwbase lamp. The casing includes a cavity tapped into one end thereof for housing the lampbase and lamp, and a plurality of vertically spaced, horizontally extending apertures tapped through the casing to reflect light. The lamp is preferably mounted above the tapped apertures, beams light downwardly, and reflects in each of the apertures, giving the illusion of additional lamps.

4 Claims, 4 Drawing Sheets

ILLUMINATED PROTECTIVE CLOTHING

BACKGROUND AND SUMMARY OF THE PRESENT INVENTION

Lighted, protective apparel is taught in a variety of U.S. patents including 4,709,307; 4,839,777; 5,070,436; and 5,128,843. Each of these patents is directed to a shirt, coat or vest which has flashing lights or light emitting diodes attached thereto, powered by a battery pack. Each of these devices functions somewhat differently and has somewhat differing objectives. Disadvantages common to each, however, include relatively limited battery life because of the load required to operate a substantial number of lights or diodes; exposed lamps or diodes that can be broken, or complex circuitry needed to generate flashing signals or other interrupted functions.

The present invention is directed to an improved protective garment having a light enhancement means designed to improve visibility of the garment through use of fewer lamps or diodes. A relatively small battery pack is sufficient to power the limited number of lamps for an extended period of time. A sliding switch which extends outwardly from the battery pack enables the user to turn off the lamps when conditions are favorable and the protective lighting is unnecessary.

The objectives of the present invention include the provision of a means for reducing the number of lights needed to provide adequate illumination, to simplify the circuitry, and to provide a protective means for the illuminating lamp or diode. Other objectives and advantages will become apparent to those skilled in the art when the following detailed description is studied in conjunction with the accompanying drawings, in which drawings.

DETAILED DESCRIPTION OF A PREFERRED EMBODIMENT

Figure 1:
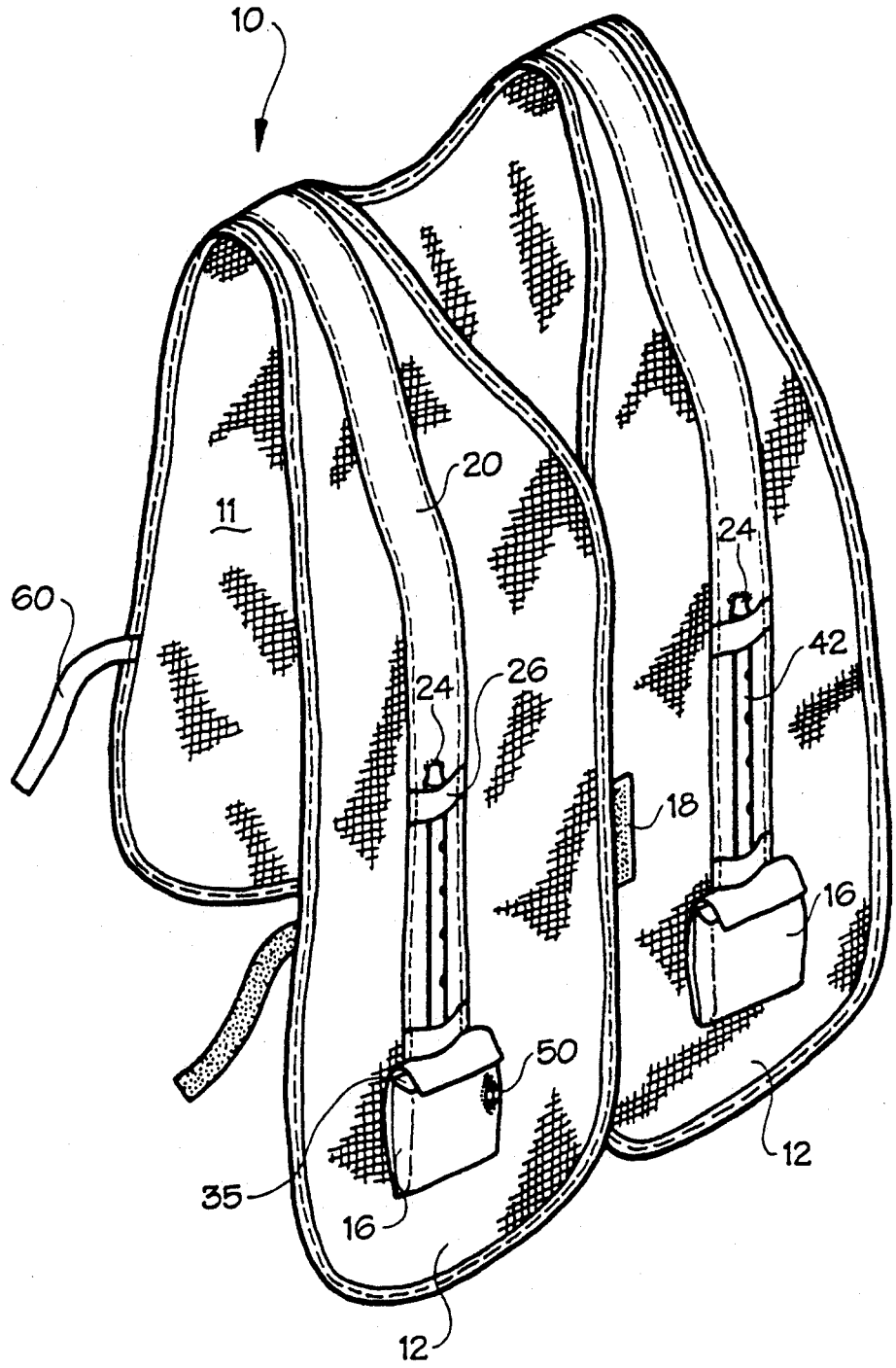
FIG. 1 is a perspective view of a preferred embodiment of the invention taken from the front of the vest.
Figure 2:
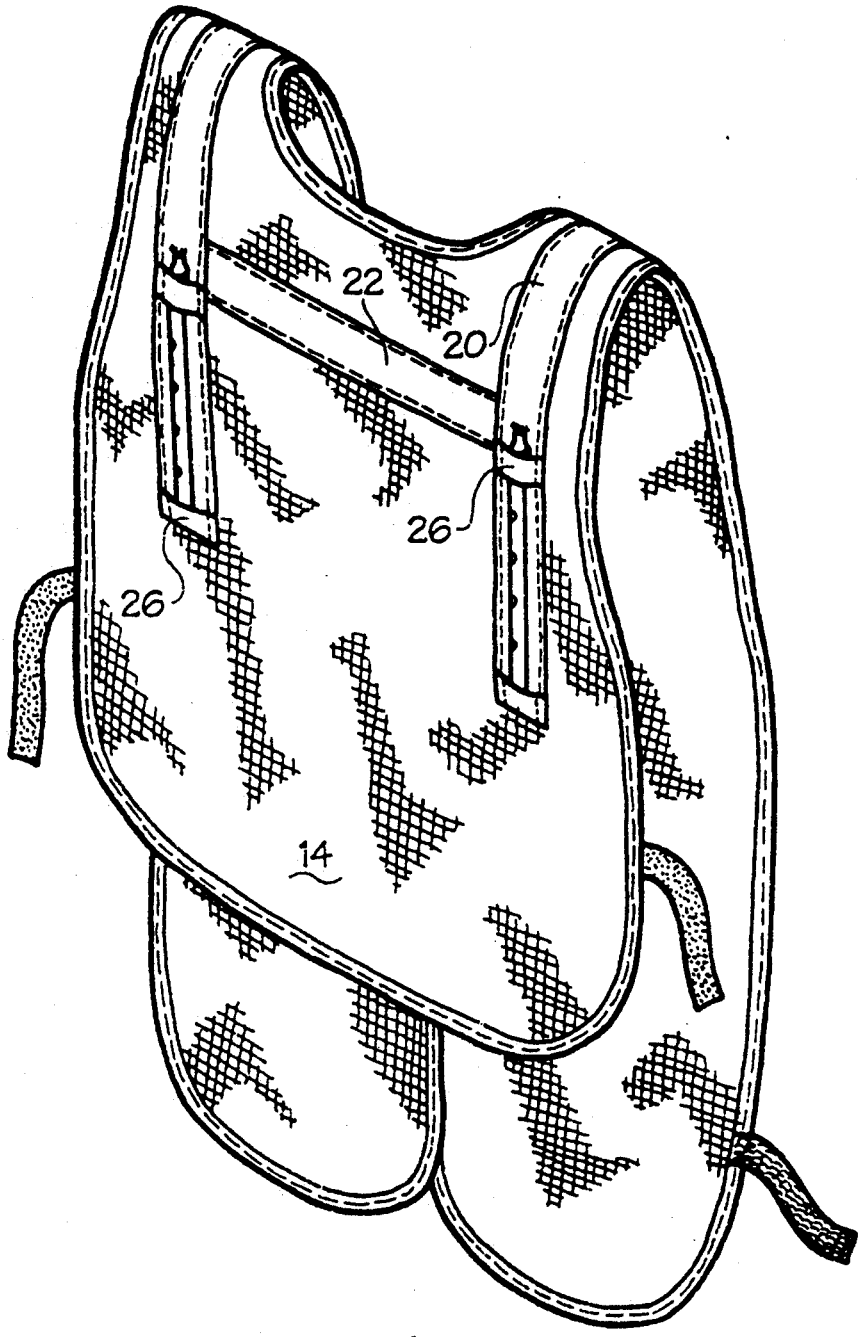
FIG. 2 is a perspective view of the embodiment shown in FIG. 1, taken from the back.

Looking first at FIG. 1, the exemplary apparel is a vest 10 formed of a brightly colored mesh material and generally designed to be worn over other clothing. The vest fabric 11 is a type primarily used for reflection of light when weather or light conditions make pedestrians or service personnel difficult to see. However, it is obvious that the preferred embodiment is equally applicable to other fabrics or other articles of clothing. Jackets, other types of vests, and some shirts would be found desirable by athletes, school children, etc., who frequently walk or train in high traffic or poorly illuminated areas.

The vest includes left and right front panels 12 and a back 14. Each front panel 12 includes a small pocket 16 on the lower portion, and Velcro or snap closures 18 along the front center edges. Extending vertically up the center of each front panel 12, over the shoulder of the garment, and down and across each side of the back 14 is a casing 20 formed from a heavy, flexible material compatible with the garment. A crosspiece 22 extends across the back of the garment to continue the casing and wiring harness between the shoulders on the back of the garment. In most embodiments the casing is formed of a textile fabric such as a twill ribbon or tape, stitched along the edges thereof to attach to the garment. The casing 20 and crosspiece 22 contains the wireing harness 25 which connects the plurality of illuminating lamps 30 to the battery power source 35.

Figure 4:
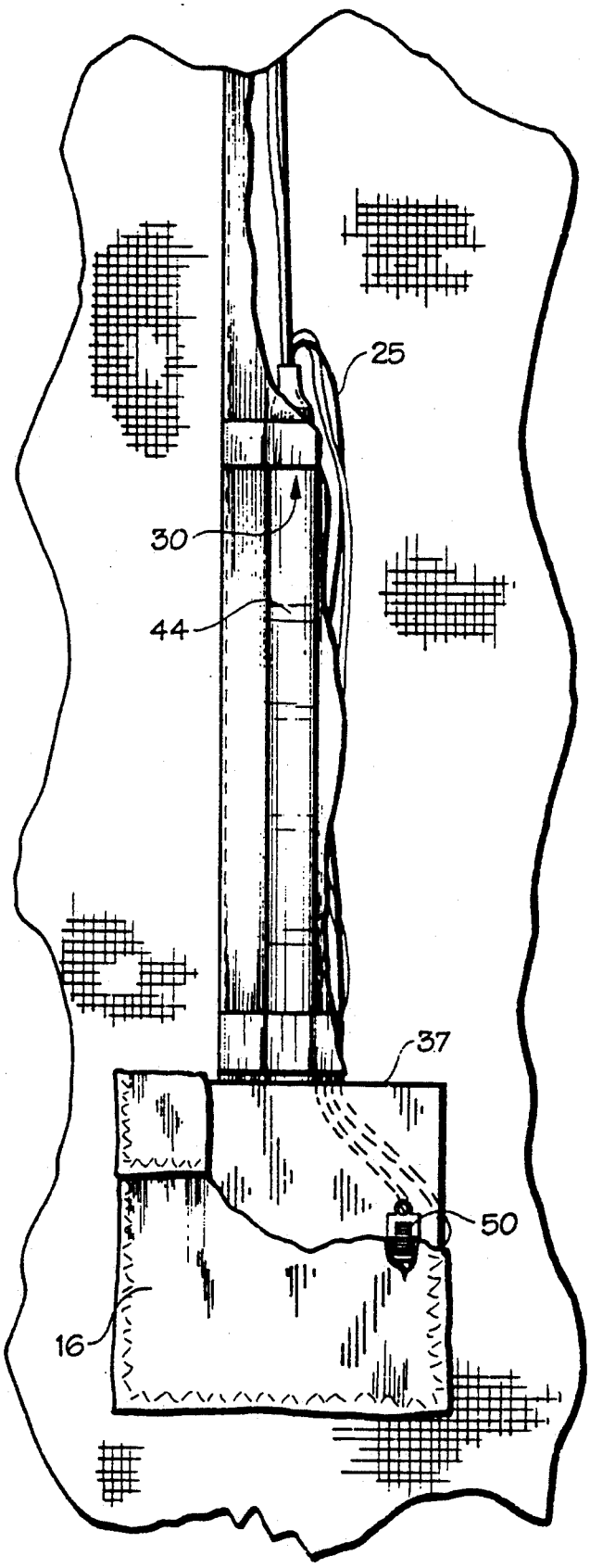
FIG. 4 is a plan view of the operative connections of the lamps to the wiring harness.

The battery power source 35 is comprised basically of a battery holder 37 (FIG. 4) which is contained in a front pocket 16. In most embodiments the battery source best suited to the present invention is comprised of our AA batteries housed in the battery holder; but other voltages might be appropriate for other environments and embodiments.

Figure 3:
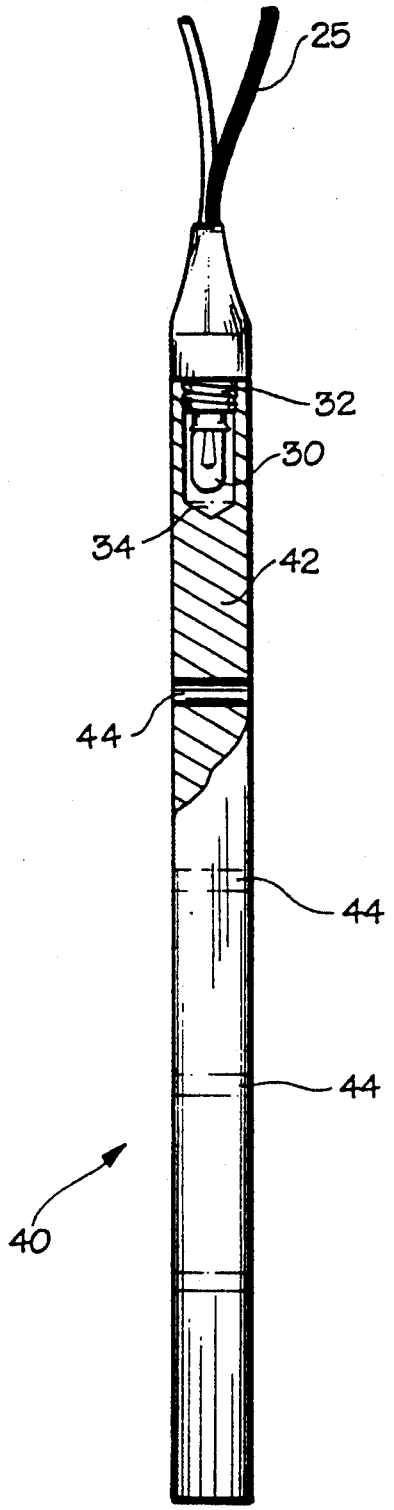
FIG. 3 is a perspective view in detail of one of the light enhancement means shown in FIGS. 1 and 2.

As best shown in FIG. 3, the lamps 30 are screwbase light bulbs mounted in subminiature lamp holders 32 which are connected to the wiring harness 25. Preferably here are a total of four lamps 30 positioned on each at the approximate vertical midpoint of each side of the front and back of the garment. At these positions, eyelets 24 are included in the casing for enabling the lamps to be connected to the wiring harness contained in the casing. Loops 26 of casing material are stitched across the front of the casing at positions determined by the terminal ends of the light enhancements means to hold them in place as described below.

Referring next to FIG. 3 each of the lamps 30 is contained in a light enhancing means 40 that is comprised of a transparent housing 42 which includes a plurality of reflective surfaces to improve the light reflecting capacity of the lamps 30. Each housing 42 is formed of a prescribed length of transparent, round, acrylic rod which is approximately three-eighths inch in diameter. The lamp 30 is mounted in the lampholder 32 in a vertical cavity 34 that has a depth sufficient to contain the lamp and lampholder such that the lamp extends downwardly into the housing 42. In the present embodiment the depth of the cavity 34 is approximately three-fourths of an inch in depth.

To form the aforementioned reflective surfaces, a plurality of apertures 44 are tapped horizontally across the diameter of the housing, in vertically spaced intervals along the length of the housing 42. Each aperture is approximately one-eighth inch in diameter and they are spaced at interval at least one inch apart along the rod. When the lamps 30 are lighted, the increase in reflective surface area resulting from the inner surfaces of the apertures 44 reflect the light emitted from lamps 30, substantially increasing the visibility of the lamps.

Because the light enhancing means 40 substantially increases the light reflected from the garment, it is possible to reduce the actual number of lamps 30 which are required to illuminate the garment. It has been found that under most conditions the use of four lamps 30 (two each front and back of the garment), powered by four AA batteries, is sufficient for safety purposes. It has also been found that this arrangement provides substantially more hours of use from each battery pack 37. Between periods of illuminated use, the switch 50 is used to turn off power to the lamps. The preferred switch 50 is a subminiature slide switch operatively connected to the battery pack contained in pocket 16. A slot cut through the pocket permits the switch to extend therethrough for ease of operation.

Velcro tabs 60, approximately four to five inches in length each, are stitched to the lower side edge of the vest shown in the drawings, for use in adjusting the fit of the garment to the individual.

When constructed as described the four subminiature lamps give the appearance of many lamps extending vertically along each side of the front and back of the garment. Each tapped aperture 44 gives the appearance of being an individual lamp. Thus it is obvious that the cost of manufacturing the vest, as well as the cost and ease of maintenance, are greatly improved by the present invention. While a preferred embodiment has been described herein, other and further modifications will be apparent to those skilled in the art, while remaining within the scope of the claims below. The materials recited herein, and the type of garment described, are for exemplary purposes only and are in no way considered to be limitations to the present invention.

What is claimed is:

1. A protective, illuminated garment of the reflective type worn by pedestrians and service personnel during periods of low visibility; said garment including:

A) a wiring harness mounted on the front and back surfaces of the body of said garment in a prescribed pattern;

B) a battery power pack contained in a selected area of said garment and being connected to said wiring harness;

C) a plurality of illuminating lamps operatively connected to said battery power pack and positioned in a prescribed pattern on the back and front surfaces of said garment;

D) a light enhancing means associated with each of said lamps for improving the reflective capacity of each of said lamps; each light enhancing means having:

i) a transparent, elongated body member having a prescribed length and width;

ii) in one end of said elongated body, a cavity tapped to a predetermined depth along the linear axis of said elongated body, for receiving and operatively containing a single lamp therein;

iii) a plurality of vertically spaced apertures along the length of said body member, each of said apertures being tapped horizontally across the width of said elongated body member for reflecting light emitted by said lamp;

iv) each of said apertures having a predetermined inner diameter, the inner surface of each said aperture forming a reflective surface off which the light emitted by said lamp is reflected.

2. A protective, illuminated garment according to claim 1 wherein said light enhancing means is formed of a length of acrylic rod having an outer diameter selected according to the overall capacity of the illuminating lamp.

3. A protective, illuminated garment according to claim 1 wherein said protective garment is a vest formed of a mesh material of a bright, light reflective color.

4. A protective, illuminated garment according to claim 2 wherein said acrylic rod has an outer diameter of at least three-eights of an inch and is cut in a length of approximately six inches, and said apertures are spaced below said cavity at approximately one inch intervals along the length of said elongated body member.

* * * * *